US007448901B2

(12) United States Patent
Weber et al.

(10) Patent No.: US 7,448,901 B2
(45) Date of Patent: Nov. 11, 2008

(54) SURFACE MOUNT POKE-IN CONNECTOR

(75) Inventors: Ronald Martin Weber, Annville, PA (US); Alan W. Bucher, Manheim, PA (US); Sheldon Lynn Horst, Columbia, PA (US)

(73) Assignee: Tyco Electronics Corporation, Middletown, PA (US)

( * ) Notice: Subject to any disclaimer, the term of this patent is extended or adjusted under 35 U.S.C. 154(b) by 19 days.

(21) Appl. No.: 11/744,241

(22) Filed: May 4, 2007

(65) Prior Publication Data

US 2008/0153327 A1 Jun. 26, 2008

Related U.S. Application Data

(63) Continuation-in-part of application No. 11/615,235, filed on Dec. 22, 2006.

(51) Int. Cl.
*H01R 11/20* (2006.01)

(52) U.S. Cl. ..... 439/427

(58) Field of Classification Search ..... 439/427, 439/413, 877, 879, 595, 327, 460, 409
See application file for complete search history.

(56) References Cited

U.S. PATENT DOCUMENTS

| | | | | |
|---|---|---|---|---|
| 2,725,545 | A * | 11/1955 | Gordon | 439/413 |
| 6,217,379 | B1 * | 4/2001 | D'Hulster et al. | 439/752.5 |
| 6,244,893 | B1 * | 6/2001 | Dudley et al. | 439/427 |
| 6,475,040 | B1 | 11/2002 | Myer et al. | |
| 7,118,429 | B1 | 10/2006 | Fabian | |
| 7,160,140 | B1 | 1/2007 | Mrakovich et al. | |
| 2006/0189174 | A1 | 8/2006 | Fabian et al. | |
| 2006/0228947 | A1 | 10/2006 | Landis et al. | |

* cited by examiner

*Primary Examiner*—Jean F Duverne

(57) ABSTRACT

A surface mount poke in connector is disclosed for mounting upon a surface of an electrical device such as printed circuit board, and is particularly applicable for printed circuit boards supporting LEDs. The connector includes a contact having an engaging mechanism for securing a first and second wire leads to the contact. The contact further has attachment points for connecting the connector to an electrical device surface by soldering.

15 Claims, 6 Drawing Sheets

SURFACE MOUNT POKE-IN CONNECTOR

CROSS REFERENCE TO RELATED APPLICATIONS

This application is a continuation-in-part, and claims the priority of U.S. non-provisional patent application No. 11/615,235 filed on Dec. 22, 2006, incorporated herein by reference in its entirety.

FIELD OF THE INVENTION

The present invention is directed to an electrical connector, and more specifically a feed-through surface mount electrical connector (SMEC) for connecting wire leads to an electrical device using surface mount technology (SMT). The electrical device may be a printed circuit board (PCB), but is not limited thereto. The PCB may contain light emitting diodes (LEDs). The invention is particularly well suited for connecting multiple PCBs in series.

BACKGROUND OF THE INVENTION

Electrical devices are often attached to printed circuit boards (PCBs) by soldering terminals of the electrical device to a surface of the PCB. Surface Mount Technology (SMT) is a particular method of soldering electrical terminals to a PCB. SMT has been developed to affix electrical devices upon PCBs in an automated manner, but the devices may also be placed manually. SMT has reduced cost, improved reliability, and reduced the overall physical size of the PCB in many applications. SMT allows for mounting electrical devices on both sides of a PCB, which was not possible using through hole mounting technology.

SMT is a method for constructing electronic circuits in which the components are mounted directly onto the surface of a PCB or other suitable component surface. SMT is a proven technology for creating electronic assemblies with higher packaging density when compared with comparable through-hole technology methods of PCB assembly. The components are typically mounted on the board by an automated method such as a robot assisted assembly line. Electrical points of contact between the components and the board may be treated with solder paste. Assembled PCBs may then be treated in a high temperature oven at temperatures of up to about 265° C. or higher to reflow the solder. The oven may be operated with an air atmosphere or under an inert atmosphere such as nitrogen.

Electronic devices so made are called surface-mount devices (SMDs). SMT has largely replaced the previous construction method of fitting components with wire leads into holes in the circuit board, which is called through-hole technology. An SMT component is usually smaller than its leaded counterpart because it has no leads or smaller leads. It may have short pins or leads of various styles, flat contacts, a matrix of balls, or other terminations on the body of the component to assist with fixing the component to the board and/or establish an electrical connection between the board and the component.

PCBs supporting light emitting diodes (LEDs) may be used to form light displays. Often, multiple LED lighting PCBs are coupled in series by two or more wires to form a string of PCBs. The string of PCBs provides for a flexible light source able to adapt to the contours of large letters used in signage. Current practice is to connect the wires to the PCBs by soldering the leads of the wires to the top surface of the PCB. The step of soldering the wire leads to the boards is time consuming and costly.

In related patent application Ser. No. 11/615,235, a connector for attaching a wire lead to a PCB was disclosed that solved many of the problems of prior art connectors. This connector received a wire lead to be connected on one side of the connector. The connector was capable of receiving more than one wire lead, but the wire leads entered the connector from the same side. When using this connector to string PCBs in series, one connector would be used to receive and secure wires from an electrical device from a first direction, and another connector would be used to receive and secure wires from another electrical device from the opposite direction. Therefore, at least two connectors were necessary to provide an electrical connection in a series string of PCBs.

Therefore, there is an unmet need to provide a single connector for securely connecting a first wire lead to an electrical device from a first direction and a second wire lead from a second electrical device from an opposite direction by a simple, reliable and cost effective process, such as a SMT automated process. The connector must approach the small physical size envelope of the wires to be soldered to the PCB so as not to shadow any neighboring components.

SUMMARY OF THE INVENTION

This invention provides for a low profile feed-through surface mounted electrical connector (SMEC) for connecting at least two wire leads to a printed circuit board (PCB) or other suitable component surface. The low profile of the connector reduces shadowing by the connector when mounted on a PCB supporting LEDs. The SMEC is attached to the PCB by surface mount technology (SMT), a standardized automated process for placing and attaching electrical and electronic components to PCBs. Attachment may be by soldering, using a conductive adhesive, or other similar method.

The connector is formed of a housing and a contact. The housing includes a first side having an opening for a first stripped wire lead to be inserted and securely connected to the contact and a second side opposite the first having an opening for a second stripped wire lead to be inserted and securely connected to the contact. The contact provides an electrical path from the first wire lead to the PCB and the second wire lead. The SMEC replaces a solder joint to connect wire leads to PCBs.

The connector may be attached to the PCB by conventional SMT techniques. The connector may be attached to the PCB by soldering the contact to the PCB surface. Alternatively, the SMEC may be attached to the surface of the PCB by the use of a conductive adhesive or solder paste or similar attachment method.

In an exemplary embodiment, the connector includes a housing having a recess configured to receive and secure a contact, a pair of openings in the housing for receiving a first wire and a second wire, a contact within the housing for receiving and securing the first wire and the second wire. The contact includes an attachment point for attaching the electrical connector to an electrical device and provides an electrical connection between the first wire and the second wire. The contact further includes a wire engaging mechanism for securing the first wire and the second wire to the contact. The wire engaging mechanism is a lance formed into the contact.

The contact may be formed by first forming a predetermined shape from a conductive sheet and then forming the predetermined shape into a cylindrical, rectangular, square or other geometry with extended attachment points. The first forming may be stamping. The conductive sheet may be formed of a phosphor bronze metal sheet with a tin plating.

The housing includes a stop for prohibiting the movement of the first wire and the second wire beyond a predetermined distance into the housing and the contact comprises a slot for receiving the stop. The stop may be a tab formed on an inside surface of the recess of the housing. Alternatively, the stop may be an indent or a slot having a spar formed into the contact.

The connector further includes a housing having two recesses and two contacts. The attachment points may include a beveled portion for improving solder reflow during soldering to a printed circuit board. The attachment points may be directed downward away from the housing to allow the attachment points to be inserted into printed circuit board through-holes.

An exemplary embodiment of a contact for creating an electrical connection between a first wire and a second wire is disclosed that includes a first receiving portion for securing a wire lead of the first wire and a second receiving portion for securing a wire lead of the second wire. The contact further includes a first engaging mechanism for securing the first wire lead into the contact and a second engaging mechanism for securing the second wire lead into the contact.

The contact also includes an attachment point for attaching the contact to a substrate. The attachment point may be capable of being soldered to the surface of an electrical device or pushed through a through-hole of an electrical device.

The first and second engaging mechanisms of the contact are a first and second lance formed into the contact. The lance may have a sharp edge for engaging the wire lead.

An exemplary embodiment of an electrical device system includes an electrical device with a surface having an electrical pathway, and an electrical connector connected to the electrical device surface. The electrical connector includes a housing and a contact. The housing includes a recess configured to receive and secure the contact and a pair of openings in the housing for receiving a first wire and a second wire. The contact receives and secures the first wire and the second wire to the connector.

The contact includes an attachment point for attaching the electrical connector to an electrical device and provides an electrical connection between the first wire, the second wire and the electrical pathway.

The electrical device of the electrical device system may be a printed circuit board. The contact includes a wire engaging mechanism for securing the first wire and the second wire to the contact. The electrical connector may be connected to the electrical device surface by soldering.

In the exemplary embodiments, the housing may be formed of a high temperature material that is lightweight and high strength, and able to operate in a high temperature environment, such as along the surface of a PCB that supports LEDs. The housing may be formed of a high temperature liquid crystal polymer (LCP) such as Zenite 6330® by E.I. du Pont de Nemours and Company of Wilmington, Del. or a high temperature nylon such as Stanyl 46 HF® by DSM Engineering Plastics North America, Inc., based in Reading, Pa., or any other known industry acceptable non-conductive high temperature resin. The housing is designed with a low profile and small footprint so that it may be placed upon a PCB supporting lighting LEDs without shadowing or blocking the light emissions of the LEDs. The housing at least partially covers the contact.

The contact has a generally cylindrical geometry. The receiving sections of the contact may have an oval cross-section while the barrel sections of the contact have a circular cross-section. The contact is formed of a conductive material, which provides an electrical connection from the wire leads to the PCB. For example, the contact may be formed of a phosphor bronze metal with a tin plating or other known industry acceptable conductive metal and plating.

The contact may be formed by first forming a predetermined shape from a conductive sheet and then forming the predetermined shape into a generally cylindrical geometry with extended attachment points. The first step in forming the contact is to stamp, cut or by other similar shaping methods form a predetermined shape from stock material. The stock material may be plated. Then, the predetermined shape is formed into the contact with extended attachment points by any material shaping method, including rolling and working. A combination of different shaping techniques may be used to complete the contact design. The extended attachment points of the contact may be provided with a beveled edge to assist in solder reflow during attachment to the PCB. Beveling the edge of the attachment points is important when pre-plated stock material is used to improve solder reflow.

The contact is formed with an engaging mechanism. The engaging mechanism is a lance, pin or other similar shape for firmly securing the wire lead within the barrel. The lance may be formed into the contact during the forming of the predetermined shape. The lance may be shaped so as to provide for an edge to engage the wire lead within the barrel. The lance may be placed at any radial location on the contact except for where forming seams are prohibitive. The lance is preferably placed on the bottom of the contact. Superior retention performance has been observed with the lance placed on the bottom since the electrical device acts as a stop to lance deformation.

Further aspects of the method and system are disclosed herein. The features as discussed above, as well as other features and advantages of the present invention will be appreciated and understood by those skilled in the art from the following detailed description and drawings.

DETAILED DESCRIPTION OF THE INVENTION

The present invention now will be described more fully hereinafter with reference to the accompanying drawings in which preferred embodiments of the invention are shown. This invention may, however, be embodied in many different forms and should not be construed as limited to the embodiments set forth herein; rather, these embodiments are provided so that this disclosure will be thorough and complete and will fully convey the scope of the invention to those skilled in the art.

Figure 1:
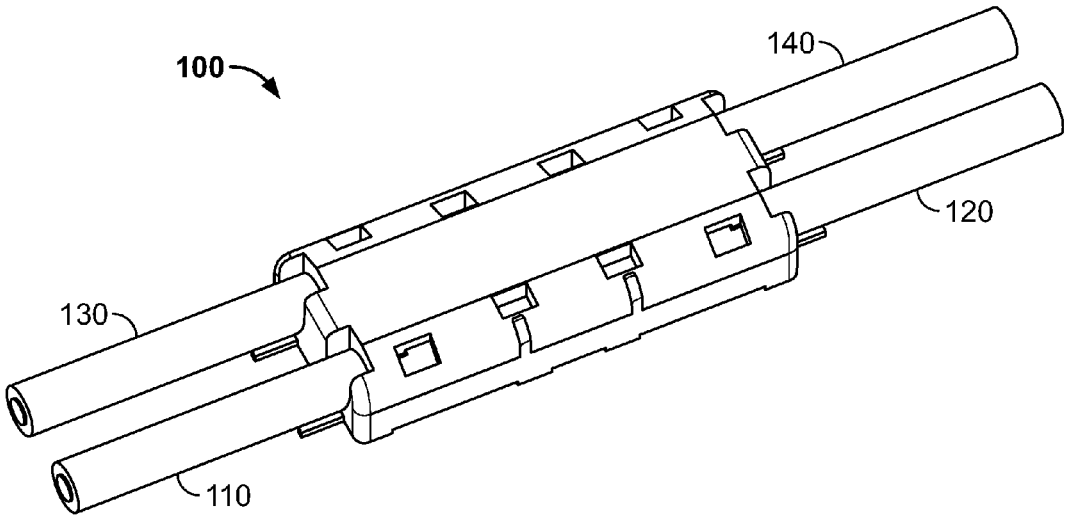
FIG. 1 illustrates an exemplary embodiment of a connector.
Figure 2:
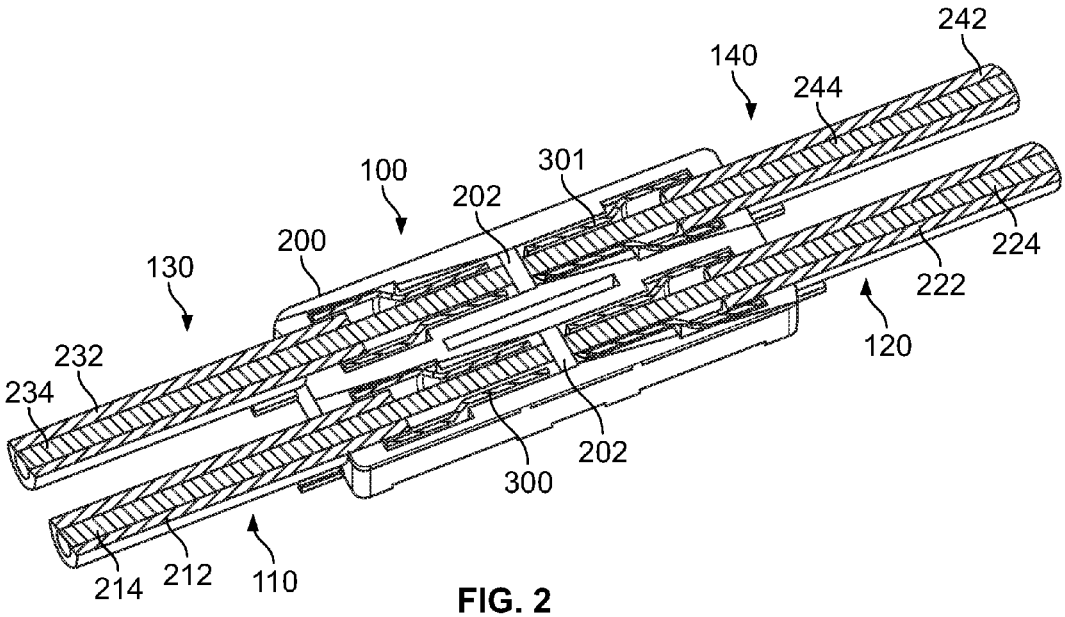
FIG. 2 illustrates a cut-away top perspective view of the exemplary embodiment of a connector

Referring to FIG. 1, an exemplary embodiment of the feed-through surface mount poke-in electrical connector 100 is depicted. The connector 100 provides a first electrical connection to a first pair of wires that includes a first wire 110 and second wire 120, and a second electrical connection to a second pair of wires that includes a third wire 130 and a fourth wire 140. The connector 100 may also connect the first wire 110 and the second wire 120 to an electrical trace (not shown) on an electrical device such as a PCB. In a similar manner, the connector 100 may also connect the third wire 130 and the fourth wire 140 to a second electrical trace (not shown) on an electrical device such as a PCB A cut-away top view of the connector 100 is shown at FIG. 2. As can be seen in FIG. 2, the connector 100 includes a housing 200, a first contact 300, and a second contact 301. As can be further seen in FIG. 2, the first wire 110 includes a first sheathed section 212 and a first conductor 214. The second wire 120 includes a second sheathed section 222 and a second conductor 224. The third wire 130 includes third sheathed section 232 and a third conductor 234. The fourth wire 140 includes a fourth sheathed section 242 and a fourth conductor 244. The wire conductors 214, 224, 234, 244 may be a solid wire, a fused stranded wire, a stranded wire, a stranded twisted wire, or any other suitable wire configuration. As can be also seen in FIG. 2, the housing 200 includes stops 202 that at least partially bisect the first contact 300 and the second contact 301 and prohibit the movement of the wires 110, 120, 130, 140 beyond a predetermined distance into the housing 200. The stops 202 provide a barrier to the wire conductors (214, 224, 234, 244) that prohibit movement beyond the stops 202.

It should be appreciated, that while the exemplary embodiment is depicted having two contacts 300, 301, the connector may be configured with only a single contact 300 to provide an electrical connection to a first wire 110 and a second wire 120, or the connector 300 may be configured with more than two contacts 300, 301 to provide an electrical connection to more than two pairs of wires.

Figure 3:
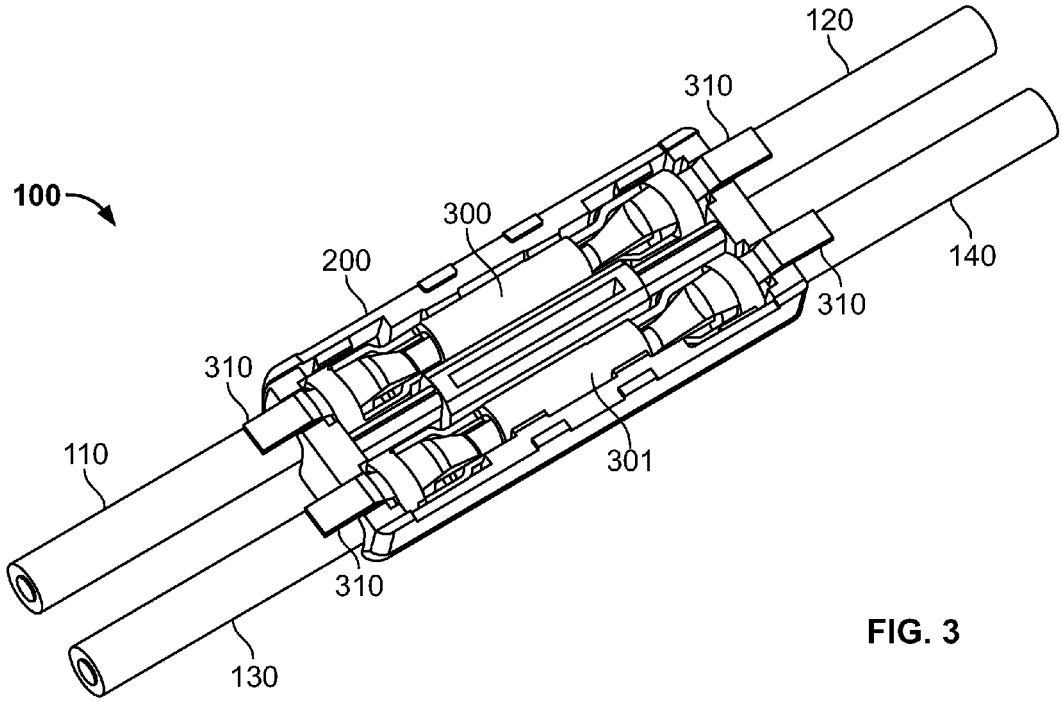
FIG. 3 illustrates a bottom perspective view of an exemplary embodiment of a connector.

A bottom view of the connector 100 is shown at FIG. 3. As can be seen in FIG. 3, the contacts 300, 301 include attachment points 310. Attachment points 310 allow the connector 100 to be physically and electrically attached to a PCB by conventional SMT methods such as soldering. The shape of the attachment point 310 may vary depending upon the surface area desired to be in contact with the PCB surface.

Figure 4:
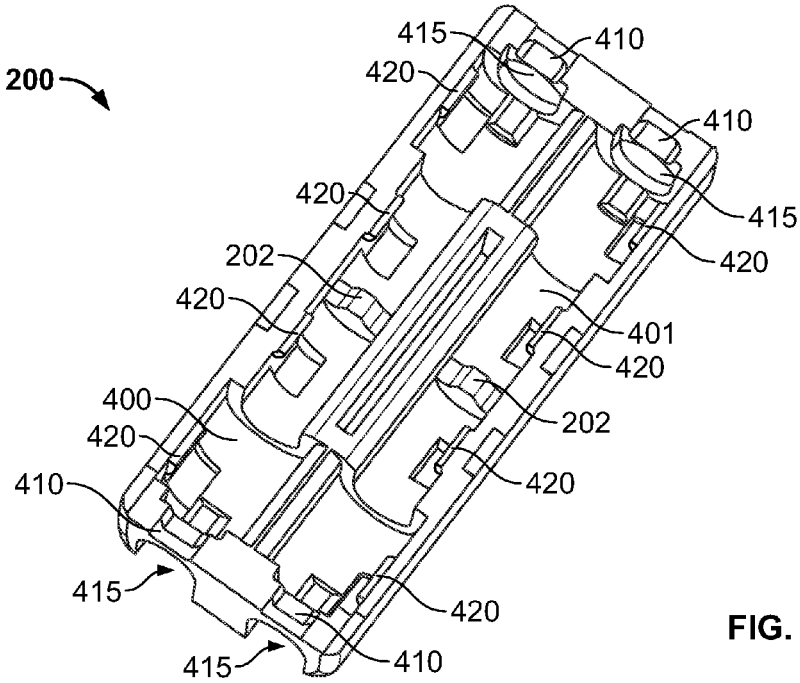
FIG. 4 illustrates a detailed bottom view of an exemplary connector housing.

A detailed view of the bottom of the housing 200 is shown at FIG. 4. As can be seen in FIG. 4, the housing includes a first recess 400 for receiving the first contact 300 and a second recess 401 for receiving the second contact 301. The stops 202 are also shown in more detail in FIG. 4. As can be seen in FIG. 4, the stops 202 are tabs formed on an inside surface of the recesses 400, 401. The housing 200 also includes slots 410 that allow attachment points 310 to extend out of the housing 200. The housing 200 further includes nibs 420 for securing the first contact 300 and the second contact 301 to the housing 200. The housing 200 also includes openings 415 that allow the wires (110, 120, 130, 140) to enter the housing 200. The stops 202 can also be seen in FIG. 4.

The housing 200 is formed of a high temperature dielectric polymer. The polymer may be a high temperature liquid crystal polymer such as Zenite 6330® by E.I. du Pont de Nemours and Company of Wilmington, Del. or a high temperature nylon such as Stanyl 46 HF®. The housing 200 may also be formed of any other known industry acceptable non-conductive high temperature resin. The heat resistance of the housing 200 allows the attachment points 310 to be connected to a PCB surface (not shown) at the temperatures used to reflow solder without damage or distortion. The housing 200 may be formed by any known plastic forming method such as injection molding.

Figure 5:
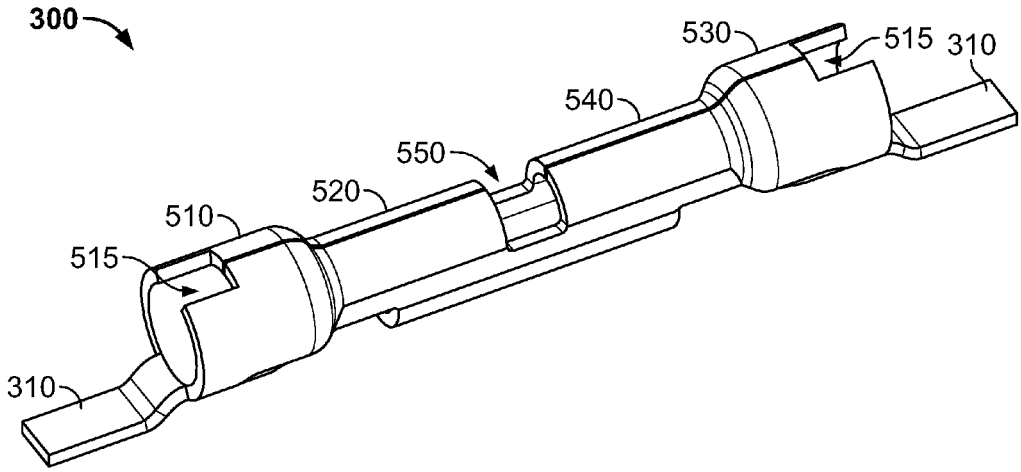
FIG. 5 illustrates a detailed view of an exemplary contact.

A detailed view of a first contact 300 from a top perspective is shown in FIG. 5. The second contact 301 (see FIG. 2) is similarly configured. The contact 300 includes a first receiving section 510, a first barrel section 520, a second receiving section 530 and a second barrel section 540. The diameter of the first receiving section 510 and the second receiving section is selected to allow for the insertion of the first sheath section 212 and the second sheath section 222 (see FIG. 2), respectively. The first barrel section 520 and the second barrel section 540 have a diameter that allows for the insertion of the first wire conductor 214 and the second wire conductor 224 (see FIG. 2), respectively. In this exemplary embodiment, the first receiving section 510 and the second receiving section 530 have a generally circular cross-section. The first barrel section 520 and the second barrel section 540 have a generally oval cross-section. Alternatively, the first barrel section 520 and the second barrel section 540 may have a generally circular cross-section.

The contact 300 also includes a slot 550 for receiving a stop 202 of the housing 200 (see FIG. 4). The contact 300 also includes attachment points 310 as shown. Attachment points 310 may be attached to a surface of an electrical device by soldering, conductive paste, or other known attachment methods. The first receiving section 510 and the second receiving section include an orientation notch 515 to assist in mating the contact 300 with the housing 200. Alternatively, the contact 300 may not be provided with the notch 515.

An exemplary embodiment of a method of forming the contact 300 will now be discussed. The contact 300 was formed by first stamping out a flat pattern blank from a tin plated phosphor bronze sheet. The sheet was a phosphor bronze metal of about 320 microns thick with a tin plating of about 3.0 to about 4.0 microns. It should be noted that the invention is not limited to this sheet or plating thickness, and that thinner or thicker sheet and plating may be selected as determined by the wire gauge and application. The flat pattern blank was then partially rolled and worked to form the contact 300.

Figure 6:
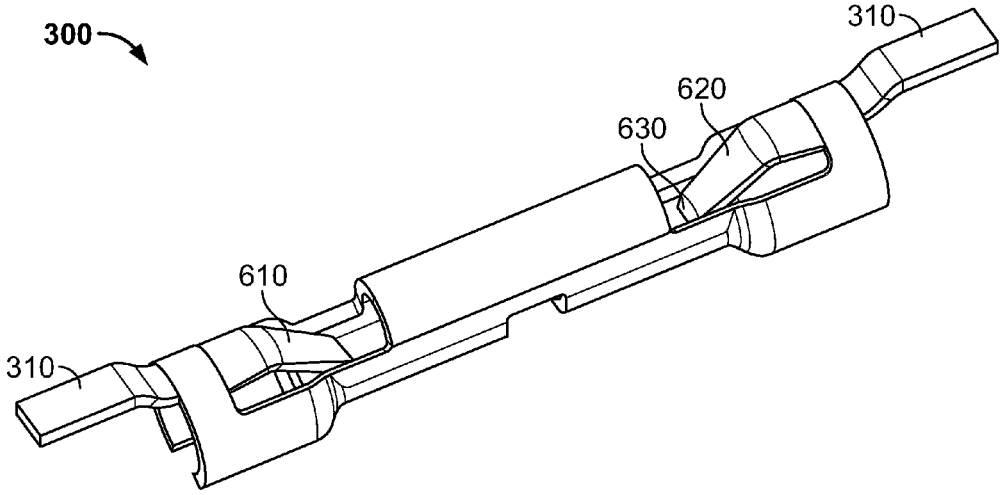
FIG. 6 illustrates a detailed view from a bottom perspective of an exemplary contact.

A detailed view of the contact 300 from a bottom perspective is shown in FIG. 6. As can be seen in FIG. 6, the contact 300 includes a first lance 610 for securing the first wire 110 (see FIG. 2) and a second lance 620 for securing a second wire 120 (see FIG. 2). The second lance 620 is provided with a beveled edge 630 to assist in securely engaging an inserted wire conductor. The first lance 610 is similarly provided with a beveled or sharp edge (not shown). Alternatively, the first lance 610 and the second lance 620 may not be provided with a beveled edge 630.

Figure 7:
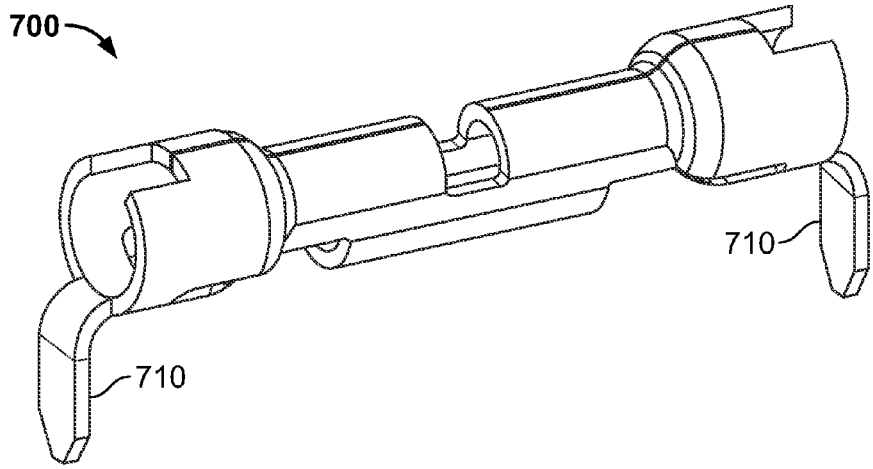
FIG. 7 illustrates a detailed view of an alternative exemplary contact.

A detailed view of an alternative embodiment of a first contact 700 is shown in FIG. 7. As can be seen in FIG. 7, the contact 700 is formed similarly to the contact 300 (FIG. 5), except that the attachment points 710 are turned downward. In this configuration, the contact 700 may be attached to an electrical device by press-fitting the attachment points 710 into through-holes of an electrical device.

Figure 8:
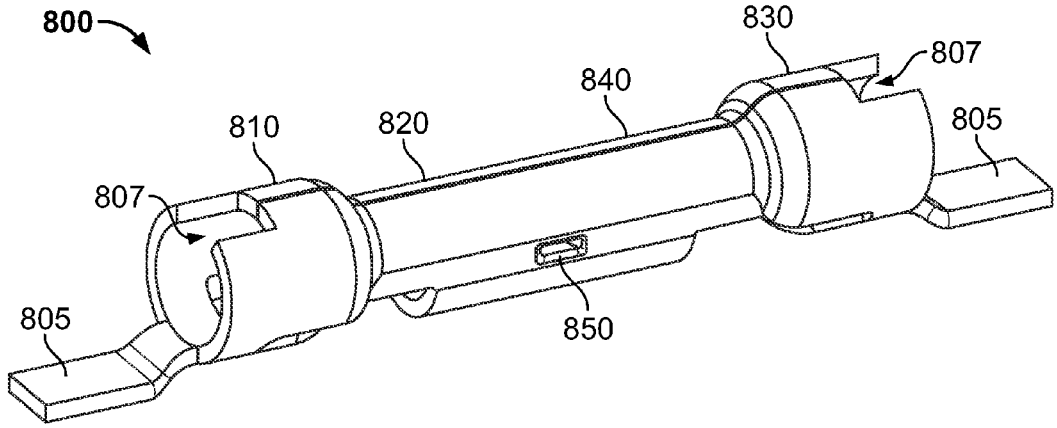
FIG. 8 illustrates a detailed view of another alternative exemplary contact.

A detailed view of another alternative embodiment of a first contact 800 is shown in FIG. 8. The contact 800 has a generally cylindrical geometry. The contact 800 includes an indent 850. The indent 850 may also be formed into the opposite side of the contact 800 (not shown). The indent 850 divides the contact 800 into a first barrel section 810, a first receiving section 820, a second barrel section 830 and a second receiving section 840. The first barrel section 810 and the second barrel section 830 have a generally cylindrical cross-section. The first receiving section 820 and the second receiving section 840 have a generally oval cross-section as shown. Alternatively, the first receiving section 820 and the second receiving section 840 may have a generally circular cross-section. The contact 800 also includes attachment points 805 and orientation notches 807.

Figure 9:
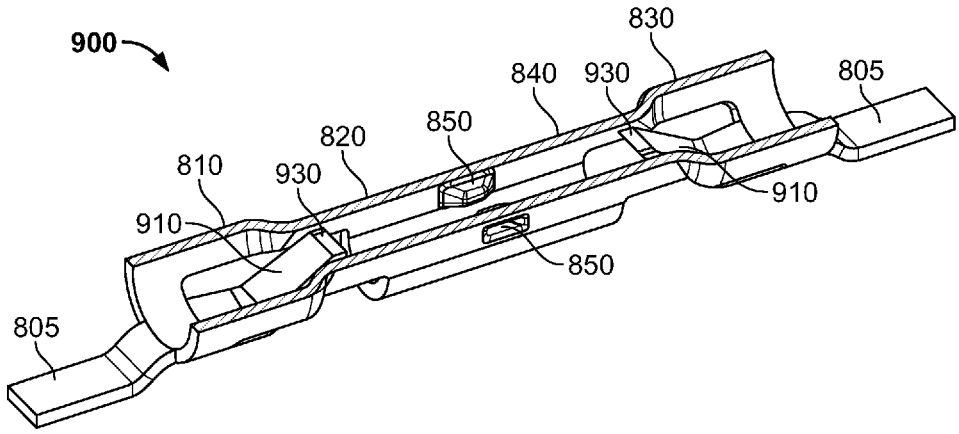
FIG. 9 illustrates a partial cutaway view of the another alternative exemplary contact of FIG. 8.

The configuration of the indent 850 can be seen more clearly in the partial cutaway view of contact 800 as shown in FIG. 9. The indent 850 extends into the contact 900 and is configured to prohibit the first conductor 214 (see FIG. 2) from being inserted past a predetermined distance through the first receiving section 820 and to prohibit the second conductor 224 (see FIG. 2) from being inserted past another predetermined distance through the second receiving section 840. Alternatively, the indent 850 may be placed in a single position or in more than two positions in order to prevent the first conductor 214 and the second conductor 224 from being inserted past a predetermined distance.

As can further be seen in FIG. 9, the contact 800 includes a first lance 910 for securing the first wire 110 (see FIG. 2) and a second lance 920 for securing a second wire 120 (see FIG. 2). The first lance 910 and the second lance 920 may be provided with a beveled edge (not shown) to assist in securely engaging an inserted wire conductor. Alternatively, the first lance 910 and the second lance 920 may not be provided with a beveled edge.

Figure 10:
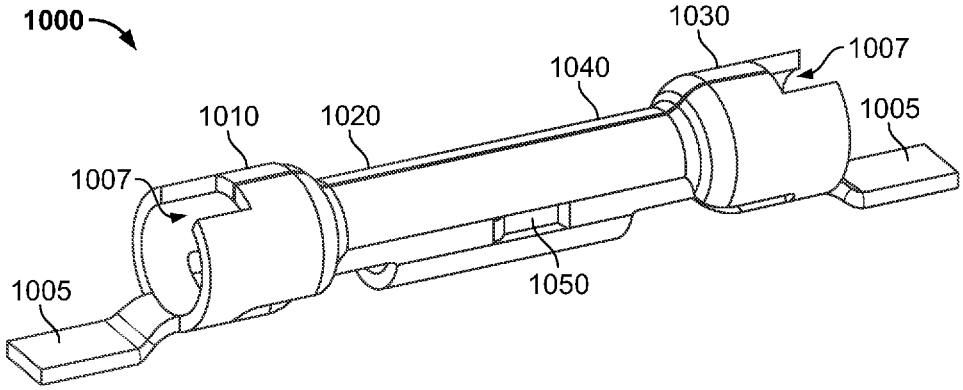
FIG. 10 illustrates a detailed view of yet another alternative exemplary contact.
Figure 11:
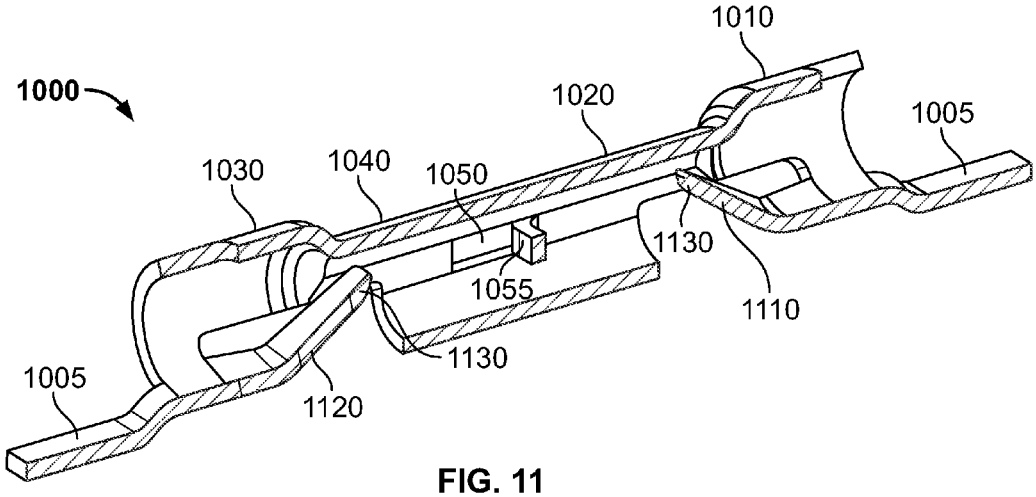
FIG. 11 illustrates a sectional view of the yet another alternative exemplary contact of FIG. 10.

A detailed view of yet another alternative embodiment of a contact 1000 is shown in FIGS. 10 and 11. FIG. 10 shows a contact 1000 from a perspective view. FIG. 11 shows a sectional view of contact 1000 from the opposite side. The contact 1000 has a generally cylindrical geometry. The contact 1000 includes a slot 1050 formed into the contact 1000 as shown in FIG. 10. The contact 1000 also includes attachment points 1005 and orientation notches 1007.

As shown in FIG. 11, the slot 1050 includes a spar 1055 that is formed when the slot 1050 is formed into the contact 1000. The spar 1055 is located approximately at the axial midpoint of the contact 1000. The spar 1055 divides the contact 1000 into a first barrel section 1010, a first receiving section 1020, a second barrel section 1030 and a second receiving section 1040. The first barrel section 1010 and the second barrel 1030 section have a generally cylindrical cross-section as shown. The first receiving section 1020 and the second receiving section 1040 have a generally oval cross-section. Alternatively, the first receiving section 1020 and the second receiving section 1040 may have a generally circular cross-section. The spar 1055 prohibits a first conductor 214 (see FIG. 2) from being inserted past a predetermined distance in the first receiving section 1020 and prohibits a second conductor 224 (see FIG. 2) from being inserted past a predetermined distance in the second receiving section 1040.

As can further be seen in FIG. 11, the contact 1000 includes a first lance 1110 for securing the first wire 110 (see FIG. 2) and a second lance 1120 for securing a second wire 120 (see FIG. 2). The first lance 1110 and the second lance 1120 are provided with a beveled edge 1130 to assist in securely engaging an inserted wire conductor. Alternatively, the first lance 1110 and the second lance 1120 may not be provided with a beveled edge 1130.

The connector 300 allows for the electrical connection of two wire conductors to each other as well as the PCB without having to solder the wire leads to the PCB or the connector 300. The housing 200 was designed with a low profile and small footprint so that it could be placed upon a PCB supporting lighting LEDs without shadowing or blocking the light emissions of the LEDs.

Figure 12:
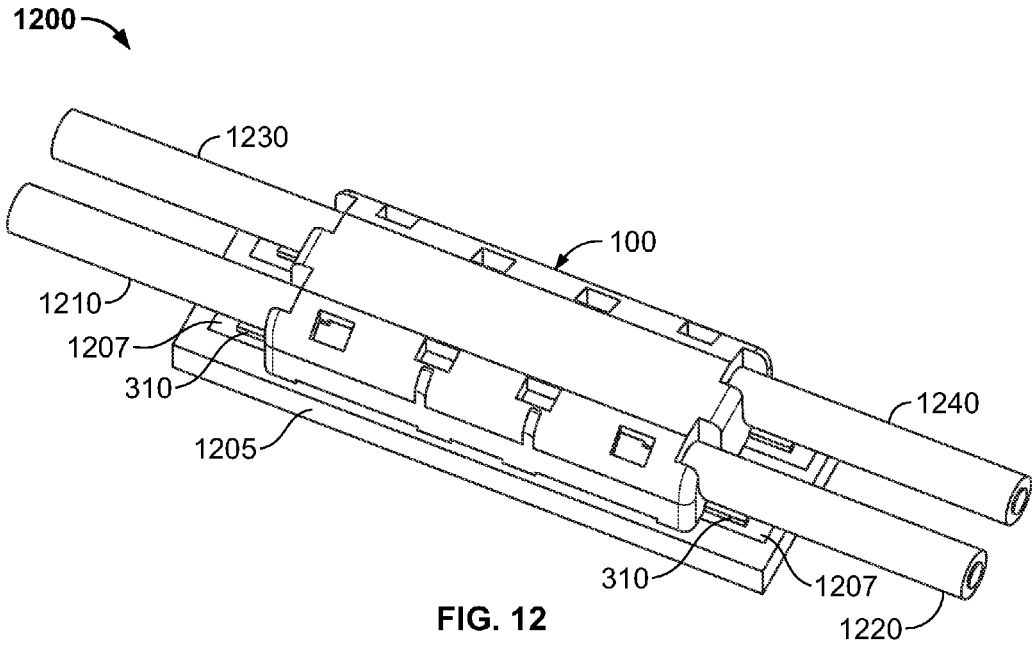
FIG. 12 illustrates an exemplary electrical device system.

FIG. 12 illustrates an exemplary electrical device system 1200 that includes a connector 100 attached to an electrical device 1205. The connector 100 includes attachment points 310. The electrical device 1205 includes contact pads 1207. The contact pads 1207 may provide an electrical connection to further electrical pathways (not shown) of the electrical device 1205. The electrical device 1205 may be a PCB. The electrical device 1205 may be of similar overall size as the connector 100, or the electrical device 1205 may be of a much larger overall size compared to the connector 100. The connector 100 is attached at the attachment points 310 to the contact pads 1207 by soldering, however, other methods including using a conductive adhesive, or other similar method may be used.

The connector 100 provides an electrical connection between a first wire 1210 and a second wire 1220. The connector 100 may further provide an electrical connection between the first wire 1210 and the second wire 1220 and the electrical device 1205 through the attachment points 310 and the contact pads 1207. Alternatively, the first wire 1210 and the second wire 1220 may be physically attached to the electrical device 1205 at the attachment points 310 and contact pads 1207, but the contact pads 1207 may not provide further electrical connection to the electrical device 1205. Similarly, the connector 100 provides an electrical connection between a third wire 1230 and a fourth wire 1240. The connector 100 may also provide an electrical connection between the third wire 1230 and the fourth wire 1240 and the electrical device 1205 through the attachment points 310 and the contact pads 1207. Alternatively, the third wire 1230 and the fourth wire 1240 may be physically attached to the electrical device 1205 at the attachment points 310 and contact pads 1207, but the contact pads 1207 may not provide an electrical connection to the electrical device 1205.

While the exemplary electrical device is shown with a single connector 100 upon the electrical device 1205, it should be understood that more than one electrical connector 100 may be attached to the electrical device 1205, and that any number of the pads 1207 may provide further electrical connection to the electrical device 1205 or any number of the pads 1207 may be used only as a physical connection.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. An electrical connector, comprising:

a housing comprising a recess configured to receive and secure a contact, a pair of openings in the housing to receive a first wire and a second wire;

a contact within the housing to receive and secure the first wire and the second wire;

wherein the contact comprises attachment points to attach the electrical connector to an electrical device; and wherein the contact provides an electrical connection between the first wire and the second wire;

wherein the contact comprises a lance formed into the contact to secure the first wire and the second wire into the contact; and wherein the attachment points are directed downward away from the housing to allow the attachment points to be inserted into printed circuit board through-holes.

2. The connector of claim 1, wherein the housing comprises a stop for prohibiting the movement of the first wire and the second wire beyond a predetermined distance into the housing and the contact comprises a slot for receiving the stop.

3. The connector of claim 2, wherein the stop comprises a tab on an inside surface of the recess.

4. The connector of claim 1, wherein the stop is an indent formed into the contact.

5. The connector of claim 1, wherein the stop is a spar formed into the contact.

6. The connector of claim 1, wherein the connector comprises two recesses and two contacts.

7. The connector of claim 1, wherein the attachment points further comprise a beveled portion for improving solder reflow during soldering to a printed circuit board.

8. A contact for creating an electrical connection between a first wire and a second wire, comprising:

a first barrel portion to receive a first wire lead of the first wire;

a second barrel portion to receive a second wire lead of the second wire;

lances formed into the contact to secure the first wire and the second wire into the contact; and an attachment point to attach the contact to a substrate;

wherein the attachment points are directed downward away from the housing to allow the attachment points to be inserted into printed circuit board through-holes.

9. The contact of claim 8, wherein the attachment point comprises two attachment feet capable of being soldered to an electrical device.

10. The contact of claim 9, wherein the contact comprises a conductive material.

11. The contact of claim 10, wherein the conductive material comprises a tin coated phosphor bronze metal.

12. The contact of claim 8, wherein the lances have a sharp edge for engaging the wire lead.

13. An electrical device system comprising:

an electrical device comprising a surface having an electrical pathway; and an electrical connector connected to the electrical device surface;

wherein the housing comprises:

a recess configured to receive and secure a contact, a pair of openings in the housing to receive a first wire and a second wire; and a contact within the housing to receive and secure the first wire and the second wire;

wherein the contact comprises attachment points to attach the electrical connector to an electrical device; and wherein the contact provides an electrical connection between the first wire, the second wire and the electrical pathway;

wherein the contact comprises a lance formed into the contact to secure the first wire and the second wire into the contact; and wherein the attachment points are directed downward away from the housing to allow the attachment points to be inserted into printed circuit board through-holes.

14. The electrical device system of claim 13, wherein the electrical device is a printed circuit board.

15. The electrical device of claim 13, wherein the electrical connector is connected to the electrical device surface by soldering.

* * * * *